US008408168B2

(12) United States Patent
Suzuki et al.

(10) Patent No.: US 8,408,168 B2
(45) Date of Patent: Apr. 2, 2013

(54) CONTROL DEVICE FOR VARIABLE WATER PUMP

(75) Inventors: Takashi Suzuki, Gotenba (JP); Satoru Onozawa, Kariya (JP)

(73) Assignees: Toyota Jidosha Kabushiki Kaisha, Toyota (JP); Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 13/148,203

(22) PCT Filed: Aug. 5, 2010

(86) PCT No.: PCT/JP2010/063312

§ 371 (c)(1),
(2), (4) Date: Aug. 5, 2011

(87) PCT Pub. No.: WO2011/021511

PCT Pub. Date: Feb. 24, 2011

(65) Prior Publication Data

US 2012/0132154 A1 May 31, 2012

(30) Foreign Application Priority Data

Aug. 21, 2009 (JP) ..... 2009-191931

(51) Int. Cl.
*F01P 5/10* (2006.01)

(52) U.S. Cl. ..... 123/41.44; 123/41.02

(58) Field of Classification Search ..... 123/41.44
See application file for complete search history.

(56) References Cited

U.S. PATENT DOCUMENTS

| | | | | |
|---|---|---|---|---|
| 4,658,766 | A * | 4/1987 | Hirano | 123/41.44 |
| 4,836,147 | A * | 6/1989 | Morris | 123/41.44 |
| 4,955,431 | A * | 9/1990 | Saur et al. | 123/41.44 |
| 2002/0111734 | A1 | 8/2002 | Wakahara et al. | |

FOREIGN PATENT DOCUMENTS

| | | |
|---|---|---|
| GB | 2 425 619 A | 11/2006 |
| JP | U-59-71922 | 5/1984 |
| JP | A-2004-316472 | 11/2004 |
| JP | A-2006-214281 | 8/2006 |
| JP | A-2007-92760 | 4/2007 |
| JP | A-2008-169750 | 7/2008 |

OTHER PUBLICATIONS

Derwent Acc No. R56069, dated May 10, 2009.*
May 23, 2012 Supplementary European Search report issued in European Application No. 10809856.7.
International Search Report dated Sep. 7, 2010 in International Application No. PCT/JP2010/063312 (with translation).

* cited by examiner

*Primary Examiner* — Noah Kamen
(74) *Attorney, Agent, or Firm* — Oliff & Berridge, PLC

(57) ABSTRACT

The ECU includes: a stop control portion controlling an electric water pump to stop, when an engine provided with the electric water pump pressure-feeding a coolant is warmed up; a first drive control portion controlling the electric water pump to drive for a predetermined period at least before the stop control portion performs a control, when a coolant temperature thw in starting the engine is equal to or higher than a predetermined value α. The electric water pump corresponds to a variable water pump capable of changing the flow rate of the coolant.

8 Claims, 6 Drawing Sheets

CONTROL DEVICE FOR VARIABLE WATER PUMP

TECHNICAL FIELD

The present invention relates to a control device for a variable water pump, the control device controlling the variable water pump for pressure-feeding coolant of an engine.

BACKGROUND ART

Conventionally, an engine generally employs a mechanical water pump for pressure-feeding or circulating coolant. The mechanical water pump is driven by the output of the engine, and the flow rate (discharging volume) depends on the rotational number of the engine. In contrast, there is known a variable water pump (for example, an electric water pump) applicable to the engine and capable of changing the flow rate of the coolant pressure-fed in order to improve the engine warm-up characteristics.

As for such a variable water pump, for example, Patent Document 1 describes a technique which causes the coolant to intermittently flow when the coolant temperature is equal to or lower than the value beforehand set. Also, for example, Patent Document 2 describes a technique which stops the electric water pump when the coolant temperature is lower than a predetermined value. Also the technique intermittently drives the electric water pump at predetermined intervals when the coolant temperature is equal to or higher than the predetermined value.

Also, for example, Patent Document 3 describes a technique which drives the electric water pump for a predetermined period when the engine starts. Also, this technique stops the electric water pump when the coolant temperature during the driving of the electric water pump is equal to or lower than a predetermined value. In the related technique described in Patent Document 3, the stop control of the electric water pump is finished based on at least one of the coolant temperature, an accumulated intake air quantity during the stopping of the electric water pump, and a stop period thereof. Further, Patent Document 3 describes a technique which drives the electric water pump for a predetermined period when a stop period of the electric water pump is longer than a predetermined period. Also, the technique continuously stops the electric water pump when the coolant temperature during the driving of the electric water pump is equal to or lower than a predetermined value.

Patent Document 1: Japanese Patent Application Publication No. 2006-214281

Patent Document 2: Japanese Patent Application Publication No. 2004-316472

Patent Document 3: Japanese Patent Application Publication No. 2008-169750

DISCLOSURE OF THE INVENTION

Problems to Be Solved by the Invention

Incidentally, in a hybrid vehicle or a vehicle performing the eco-run control, the engine can be intermittently driven or stopped for a relatively short period. In this case, the stop period of the engine is relatively short and the coolant temperature is not cooled down to as low as an outside air temperature. Therefore, the coolant temperature is not uniform in starting the engine subsequently. This may result in that the coolant temperature in a portion, of the engine, where heat load is large is partially increased as compared with the coolant temperature in the other portions.

In the technique described in Patent Document 1 or 2, it is determined whether the coolant is allowed to intermittently flow or the electric water pump is stopped on the basis of the coolant temperature obtained from the output of a water temperature sensor. However, the water temperature sensor is generally installed in the coolant outlet portion of the engine. That is, the coolant temperature detected by the output of the water temperature sensor is not the coolant temperature in the portion where the heat load is large. For this reason, in these described techniques, the coolant might be partially boiled in the portion where the heat load is large, when the coolant is allowed to intermittently flow in stating the engine just after a short stop period of the engine, or when the electric water pump is stopped.

Additionally, it is considered to further provide a water temperature sensor or a pressure sensor detecting a state of the coolant in the portion where the heat load is large. However, the cost is increased by the more provision of the sensor in this case without exception. Thus, it is not preferred as measures.

On the other hand, the technique described in Patent Document 3 drives the electric water pump for a predetermined period in starting the engine, and stops the electric water pump on the basis of the coolant temperature detected during the driving thereof. In other words, the technique described in Patent Document 3 circulates the coolant at once, whereby the coolant temperature partially increased is detected by the water temperature sensor. On the basis of the detected result, the electric water pump is stopped. For this reason, it is considered that the technique described in Patent Document 3 can prevent the coolant from partially boiling in starting the engine.

However, an electric water pump has to be driven in starting the engine in the technique described in Patent Document 3. In other words, in the technique, the electric water pump has to be driven even when the partial boiling is not possible. This might result in that that the promotion in the warm-up of the engine is limited more than necessary in the technique. In this regard, it is considered that the degradation of the mileage or the exhaust emission depending on the limit is relatively small with respect to each time or the frequency of occurrence. However, in view of the importance of the environmental problem in these days, there is a problem in that the fuel consumption or the exhaust emission might be degraded to such an extent that cannot be ignored cumulatively in consideration of long-time use.

Also, in the technique described in Patent Document 3, the electric water pump is driven for a predetermined period when the stop period of the engine is longer than a predetermined period. In addition, the electric water pump is continuously stopped when the coolant temperature during the driving of the electric water pump is equal to or lower than a predetermined value. In other words, the described technique prevents the partial boiling during the warm-up of the engine.

However, in the described technique, it is necessary to drive the electric water pump again during the warm-up of the engine, when the stop period of the electric water pump is longer than a predetermined period and the coolant temperature during the driving of the electric water pump is equal to or lower than a predetermined value. For this reason, in the described technique, even when the stop control of the electric water pump is continued, the period of the stop control is limited by the period of the driving of the engine. That is, there is a problem in that it is considered that the promotion of the warm-up of the engine is limited due to the configuration of the control in the described technique.

The present invention has been made in view of the above circumstances and has an object to provide a control device for a variable water pump, the control device which prevents coolant from partially boiling without limiting the promotion of the warm-up more than necessary in starting an engine, and suitably promotes the warm-up while preventing the coolant from partially boiling.

Means for Solving the Problems

The present invention has been made in view of the above circumstances and has an object to provide to a control device for a variable water pump, the control device including: a stop control portion controlling the variable water pump to stop, when an engine provided with the variable water pump pressure-feeding a coolant is warmed up; and a first drive control portion controlling the variable water pump to drive for a predetermined period at least before the stop control portion performs a control, when a coolant temperature in starting the engine is equal to or higher than a first predetermined value.

The present invention may further include: an estimation portion estimating a coolant temperature in a predetermined part of the engine, when the engine is warmed up; and a second drive control portion controlling the variable water pump to drive, when the coolant temperature estimated by the estimation portion is equal to or higher than a second predetermined value.

In the present invention, the stop control portion may control the variable water pump to stop, when the coolant temperature is equal to or lower than a third predetermined value smaller than the first predetermined value.

In the present invention, the stop control portion may control the variable water pump to stop, when the coolant temperature estimated by the estimation portion is equal to or lower than a fourth predetermined value smaller than the second predetermined value.

In the present invention, the estimation portion may calculate a quantity of heat received by the coolant on the basis of one of a rotational number of the engine, an output of a shaft of the engine, and an quantity of intake air, calculate a coolant temperature difference between the coolant temperature in the predetermined part and a coolant temperature in a coolant outlet portion of the engine on the basis of the quantity of heat, and calculate the coolant temperature in the predetermined part by adding the coolant temperature difference to the coolant temperature in the coolant outlet.

In the present invention, the estimation portion may estimate the coolant temperature in the predetermined part on the basis of the coolant temperature and an accumulated intake air quantity.

The present invention may further include a third driving control portion controlling the variable water pump to pressure-feed a second flow rate of the coolant smaller than a first flow rate of the coolant before controlling the variable water pump to pressure-feed the first flow rate of the coolant, in a case where an operational state of the variable water pump is shifted from a stop state controlled by the stop control portion into a drive state.

Also, the present invention has another object to provide another object of a control device for a variable water pump, the control device including: a stop control portion controlling the variable water pump to stop, when an engine provided with the variable water pump pressure-feeding a coolant is warmed up; a first drive control portion controlling the variable water pump to drive for a predetermined period at least before the stop control portion performs a control, when a coolant temperature in starting the engine is equal to or higher than a first predetermined value; an estimation portion estimating a coolant temperature in a predetermined part of the engine, when the engine is warmed up; a second drive control portion controlling the variable water pump to drive, when the coolant temperature estimated by the estimation portion is equal to or higher than a second predetermined value; and a third drive control portion controlling the variable water pump to pressure-feed a second flow rate of the coolant smaller than a first flow rate of the coolant, before controlling the variable water pump to pressure-feed the first flow rate of the coolant, in a case where an operational state of the variable water pump is shifted from a stop state into a drive state by the second drive control portion, and the third drive control portion controlling the variable water pump to pressure-feed the first flow rate of the coolant, when a predetermined period is elapsed from a time when the controlling the variable water pump to pressure-feed the second flow rate of the coolant is started.

Effects of the Invention

According to the present invention, the coolant can be prevented from partially boiling without limiting the promotion of the warm-up more than necessary in starting an engine, and the warm-up is suitably promoted while the coolant is prevented from partially boiling.

BEST MODES FOR CARRYING OUT THE INVENTION

In the following, the embodiment according to the present invention will be described with reference to figures.

[First Embodiment]

Figure 1:
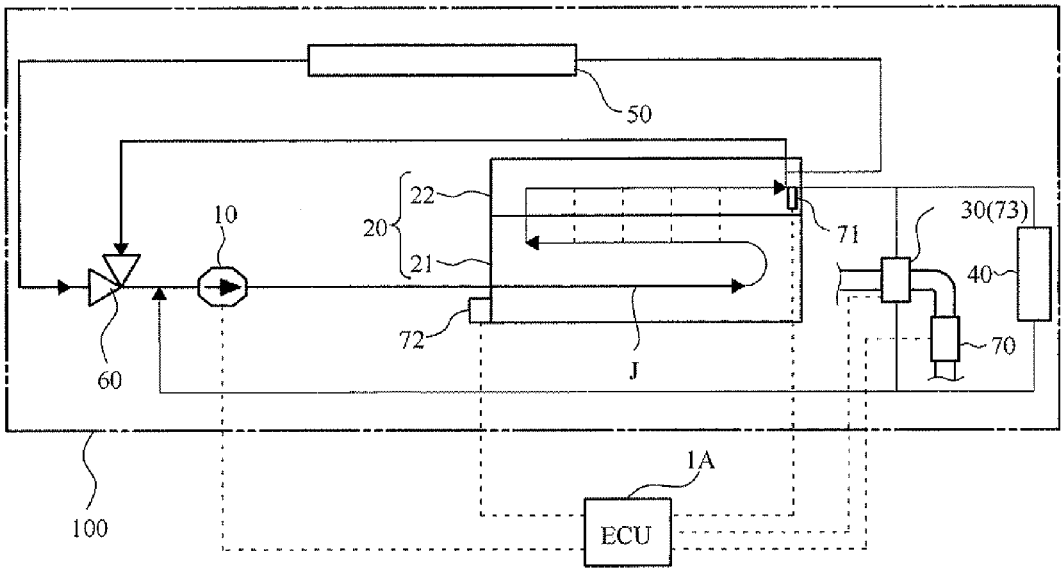
FIG. 1 is a schematic view of an engine cooling system 100 with a control device, achieved by an ECU 1A, according to a first embodiment, for a variable water pump.

An engine cooling system 100 and an ECU 1A will be explained with reference to FIG. 1. The engine cooling system 100 and the ECU 1A are installed in a hybrid vehicle not illustrated. The engine cooling system 100 includes: an electric water pump (hereafter merely referred to as W/P) 10; an engine 20; an electrical control throttle 30; a heater 40; a radiator 50; a thermostat 60; and an airflow meter 70. The W/P 10 pressure-feeds and circulates the coolant. The W/P 10 corresponds to a variable water pump which can change the flow rate of the coolant (the flow rate of the coolant can be changed to at least zero).

The engine 20 includes a cylinder block 21 and a cylinder head 22. A water jacket J is provided within the cylinder block 21 and the cylinder head 22. The coolant discharged from the W/P 10 flows through the water jacket J from the cylinder block 21 to the cylinder head 22. The cylinder head 22 is provided with the coolant outlet portion of the engine 20, and a water temperature sensor 71 is provided at the coolant outlet portion. In addition, a crank corner sensor 72 is provided in the engine 20.

The coolant is discharged from the cylinder head 22 through three distribution paths. One of these paths is diverged into two paths, one of which is provided with an electrical control throttle 30, and the other of which is provided with the heater 40. These paths passes through the electrical control throttle 30 and the heater 40, joins each other again in the downstream side thereof, and arrives at the W/P 10. The electrical control throttle 30 adjusts the quantity of the intake air of the engine 20. A throttle position sensor 73 is built in the electrical control throttle 30. The heater 40 exchanges heat between the coolant and air to warm the air. The warmed air can be used in a heater for the vehicle interior. In an intake system, the airflow meter 70 to measure the quantity of intake air of the engine 20 is provided in the upstream side of the electrical control throttle 30.

The other path is a radiator path arriving at the W/P 10 through the radiator 50 and the thermostat 60. The radiator 50 is a heat exchanger which cools the flowing coolant by use of the wind generated by a fun not illustrated or by the driving of the vehicle. The other remaining path is a bypass path which arrives at the W/P 10 through the thermostat 60 without passing through the radiator 50. The thermostat 60 switches the radiator path and the bypass path depending on the coolant temperature. Specifically, the thermostat 60 closes the radiator path and opens the bypass path when the coolant temperature is lower than a predetermined value (for example, 75 degrees Celsius), and opens the radiator path and closes the bypass path when the coolant temperature is equal to or higher than the predetermined value.

The ECU 1A includes: a microcomputer including a CPU, a ROM, and a RAM; and an input-output circuit. The ECU 1A is electrically connected to the W/P 10 as a controlled object. Also, the ECU 1 is electrically connected to various sensors such as the airflow meter 70, the water temperature sensor 71, the crank angle sensor 72, and the throttle position sensor 73. In this regard, the ECU 1A detects the intake air quantity on the basis of the output of the airflow meter 70, the coolant temperature thw in the coolant outlet portion of the engine 20 on the basis of the output of the water temperature sensor 71, and the engine rotational number NE on the basis of the output of the throttle position sensor 73. Also, the ECU 1A detects the shaft output PE of the engine 20 on the basis of the outputs of the airflow meter 70 and the throttle position sensor 73.

The ROM stores map data and programs describing various processes performed by the CPU. The CPU performs processes while utilizing a temporal memory area of the RAM if necessary on the basis of the programs stored in the ROM. This functionally achieves a control portion, a determination portion, a detection portion, a calculation portion, and the like in the ECU 1A.

Specifically, the ECU 1A functionally achieves a stop control portion, a drive control portion, and an estimation portion mentioned below. The stop control portion is achieved to control the W/P 10 to stop while the engine 20 is being warmed up. The drive control portion is achieved to drive the W/P 10 for a predetermined period when the coolant temperature thw in starting the engine 20 is equal to or higher than a first predetermined value $\alpha$, before the stop control portion performs the stop control. Such a portion achieved above, of the drive control portion, corresponds to the first drive control portion. The estimation portion is achieved to estimate the coolant temperature in a predetermined portion of the engine 20 (herein, the estimated coolant temperature Tmax within the head), while the engine 20 is warmed up or while the W/P 10 is stopped by the stop control portion (the warm-up of the engine 20 is being promoted). This predetermined portion where the heat load is the highest among the engine 20 is positioned within the cylinder head 22.

Figure 2:
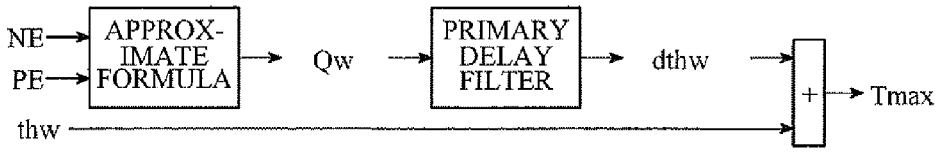
FIG. 2 is a schematic view of a control of an estimation portion according to the ECU 1A.

Specifically, the estimation portion is achieved to estimate the coolant temperature in the predetermined portion, as illustrated in FIG. 2. In other words, the cooling loss Qw which is the quantity of the heat received by the coolant is calculated by an approximation formula on the basis of the engine rotational number NE and the engine shaft output PE. Alternatively, the estimation portion which is the quantity of the heat received by the coolant may be calculated by an approximation formula on the basis of the engine rotational number NE and the instantaneous intake air quantity ga. Next, the estimation portion calculates the water temperature difference dthw in temperature between the coolant in the predetermined portion of the engine 20 and the coolant in the coolant outlet portion by the use of a primary delay filter on the basis of the calculated cooling loss Qw. Further, the estimation portion adds the calculated water temperature difference dthw to the coolant temperature thw in response to the output of the water temperature sensor 71, thereby calculating the in-head estimation water temperature Tmax. The in-head estimation water temperature Tmax is estimated on the precondition that the coolant temperature is substantially uniform at the time of starting the estimation.

The estimation portion is achieved in such a manner. On the other hand, the control stop portion is achieved to stop the W/P 10 when the coolant temperature is lower than a predetermined value (here, threshold a) and the in-head estimation water temperature Tmax is lower than a second predetermined value (here, threshold b). Meanwhile, the drive control portion is achieved to drive the W/P 10 even when the in-head estimation water temperature Tmax is equal to or higher than the second predetermined value (here, threshold b). Such a portion achieved above, among the drive control portion, corresponds to the second drive control portion. Also, the drive control portion is achieved to drive the W/P 10 even when the coolant temperature is equal to or higher than a predetermined value (here, threshold a). In these cases, to drive the W/P 10, the drive control portion is achieved to perform a given control rather than a control to drive the W/P 10 for a predetermined period.

Additionally, the drive control portion controls the W/P 10 to drive when the coolant temperature is equal to or higher than a predetermined value (here, threshold a). On the other hand, it is desirable that the stop control portion should stop the W/P 10 when the coolant temperature is equal to or lower than a predetermined value (here, a-x) smaller than the predetermined value, instead of stopping the W/P 10 immediately when the coolant temperature is equal to or lower than the predetermined value (here, threshold a). This is caused by a following reason. That is, the drive control of the W/P 10 is performed at the time when the coolant temperature is equal to or higher than a predetermined value (here, threshold a), just after that, so the coolant temperature is reduced. This may result in that the coolant temperature is lower than the predetermined value (here, threshold a). In this case, the driving and the stopping of the W/P 10 are repeated. However, a predetermined value according to the drive control portion is set to the threshold a and a predetermined value according to the stop control portion is set to the threshold a-x, thereby preventing the W/P 10 from repeating the driving and the stopping. This is similar to the in-head estimation water temperature Tmax.

Thus, the portion corresponding to the first drive control portion of the drive control portion controls the W/P 10 to drive for a predetermined period, when the coolant temperature thw is equal to or higher than the first predetermined value α. The stop control portion controls the W/P 10 to stop when the coolant temperature is equal to or lower than a third predetermined value smaller than the first predetermined value α. Also, the portion corresponding to the second drive control portion of the drive control portion controls the W/P 10 to drive, when the in-head estimation water temperature Tmax is equal to or higher than the second predetermined value. The stop control portion controls the W/P 10 to stop, when the in-head estimation water temperature Tmax is equal to or lower than a fourth predetermined value smaller than the second predetermined value.

Figure 3:
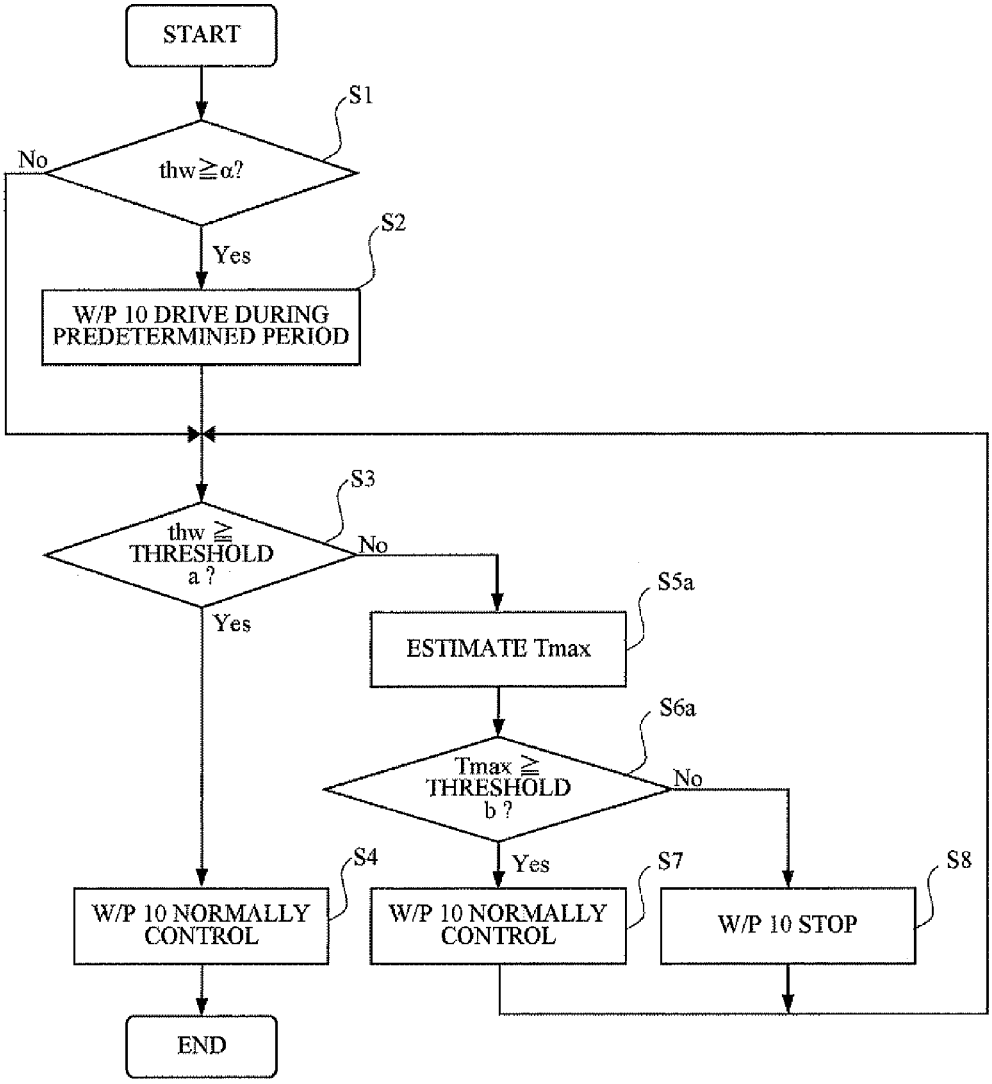
FIG. 3 is a view of a flowchart of an operation of the ECU 1A.

The operation of the ECU 1A will be described with reference to a flow chart in FIG. 3. Additionally, this flow chart starts in starting the engine 20. The ECU 1A determines whether or not the coolant temperature thw is equal to or higher than the first predetermined value α (step S1), The first predetermined value α is a determination value for determining whether or not the coolant temperature in starting the engine 20 is almost uniform. For example, the first predetermined value α can be set to about the outside air temperature (for example, from about 20 to about 40 degrees Celsius). When the determination is affirmative in step S1, it is determined that the coolant temperature is not almost uniform. The ECU 1A controls the W/P 10 to drive for a predetermined period (step S2). This predetermined period is set beforehand such that the coolant temperature is almost uniform. Specifically, this predetermined period can be set to the period while the coolant circulates around. The coolant temperature is made uniformed in this step.

On the other hand, when the determination is negative in step S1, it is determined that the coolant temperature is almost uniform. When the determination is negative in step S1, or after the step S2, the ECU 1 determines whether or not the coolant temperature thw is equal to or higher than the threshold a (step S3). This threshold a is a determination value for determining whether or not the warm-up of the engine 20 is accomplished. For example, the threshold a can be set to the temperature (here, 75 degrees Celsius) which means the accomplishment of the warm-up of the engine 20. When the determination is affirmative in step S3, the ECU 1A drives the W/P 10 based on the normal control (step S4).

On the other hand, when the determination is negative in step S3, the ECU 1A estimates the in-head estimation temperature Tmax (step S5*a*). Subsequently, the ECU 1A determines whether or not the estimated in-head estimation temperature Tmax is equal to or higher than the threshold b (step S6*a*). This threshold b is a determination value for determining whether or not the partial boiling happens during the warm-up of the engine 20. For example, the threshold b can be set to the temperature (for example, 108 degrees Celsius) which means the boiling point of the coolant. Also, this can be set in consideration of responsiveness or an error of the estimation.

When the determination is negative in step S6*a*, it is determined that the partial boiling is not possible. At this time, the ECU 1A stops the W/P 10 (step S8). This promotes the warm-up of the engine 20. On the other hand, when the determination is affirmative in step S6*a*, it is determined that the partial boiling is possible. At this time, the ECU 1A drives the W/P 10 based on the normal control (step S7). This can prevent the coolant from partially boiling in starting the engine 20. Before that, the ECU 1A drives the W/P 10 for a predetermined period in starting the engine 20 if necessary in step S2. This also can prevent the limit of the promotion of the warm-up in starting the engine 20 more than necessary.

The process returns to step S3 after step S7 or step S8. Until the determination is affirmative in step S3, the in-head estimation water temperature Tmax is estimated and determined in step S5*a* and step S6*a*, respectively. After that, the process proceeds to step S7 or step S8. This can promote the warm-up of the engine 20 and prevent the coolant from partially boiling during the warm-up of the engine 20.

During this period, the ECU 1A estimates the in-head estimation water temperature Tmax on the precondition that the coolant temperature is substantially uniform in starting the estimation in step S5*a*. Before that, the ECU 1A makes the coolant temperature uniform in step S2 when the coolant temperature in starting the engine 20 is not almost uniform. This can prevent an error of an initial value when the in-head estimation water temperature Tmax is estimated, thereby suppressing an error of the estimation due to the above error. The in-head estimation water temperature Tmax is suitably estimated and is used in the determination of the partial boiling. Therefore, the ECU 1A can prevent the coolant from partially boiling in starting the engine 20 and during the warm-up of the engine 20, and suitably promote the warming up of the engine.

For example, the partial boiling is prevented, thereby restricting the degradation of a part caused by an increase in inner pressure of the path of the coolant. This can protect the part. Thus, the ECU 1A can satisfy both of the mileage improvement caused by the warm-up promotion and the part protection at a high level. Also, the portion corresponding to the first drive control portion mentioned above controls the W/P 10 to drive for a predetermined period, "at least" before the stop control portion performs the control. This meaning includes a case where the stop control portion does not perform the control (for example, the coolant temperature thw in starting the engine 20 is equal to or higher than each of the predetermined value a and the threshold a), as considering that the case is possible.

[Second Embodiment]

An ECU 1B according to the present embodiment is substantially similar to the ECU 1A, except that the estimation portion is functionally achieved as described later and the stop control portion and the second drive control portion are functionally achieved as described later. For this reason, the ECU 1B is omitted in figures. For example, the ECU 1B instead of the ECU 1A can apply to the engine cooling system 100.

In the ECU 1B, the estimation portion is achieved to estimate the in-head estimation water temperature Tmax on the basis of the coolant temperature thw and the accumulated intake air quantity. Specifically, the estimation portion is achieved to estimate the in-head estimation water temperature Tmax on the basis of the current coolant temperature thw and the accumulated intake air quantity Ga for a predetermined period (here, 10 seconds) immediately before. The accumulated intake air quantity Ga corresponds to a supply heat quantity supplied from the combustion gas to the cylinder head 22.

In the estimation of the in-head estimation water temperature Tmax, the ROM of the ECU 1B stores map data in which the determination value (here, threshold c) of the accumulated intake air quantity Ga corresponding to the in-head estimation water temperature Tmax in boiling the coolant. On the other hand, the estimation portion is achieved to detect the current coolant temperature thw and read the determined value (here, threshold c) with reference to the map data. The estimation portion is achieved to calculate the accumulated intake air quantity Ga and determine whether or not the current coolant temperature thw is equal to or higher than the determination value (here, threshold c).

In this regard, the in-head estimation water temperature Tmax can be set as a reference for the current coolant temperature thw and the accumulated intake air quantity Ga. The in-head estimation water temperature Tmax in boiling the coolant can be set as a reference for the threshold c. For this reason, the estimation portion is achieved to substantially estimate the in-head estimation water temperature Tmax on the basis of the coolant temperature thw and the accumulated intake air quantity Ga with reference to the map data and the determination by the map data.

On the other hand, in conjunction with the estimation portion achieved in such a way, in the present embodiment, the stop control portion is achieved to control the W/P 10 to stop in cases where the coolant temperature is lower than the determined value (herein, threshold a) and "the accumulated intake air quantity Ga calculated is smaller than the determination value (herein, threshold c)" rather than in cases where "the in-head estimation water temperature Tmax is lower than the second determined value (herein, threshold b)". Additionally, the stop control portion is substantially similar to the ECU 1A, except for the above point. Also, the portion corresponding to the second drive control portion is achieved to control the W/P 10 to drive in cases where "the accumulated intake air quantity Ga calculated is equal to or larger than the determination value (herein, threshold c)" in stead of cases where the in-head estimation water temperature Tmax is equal to or higher than the second determined value (herein, threshold b)".

Figure 4:
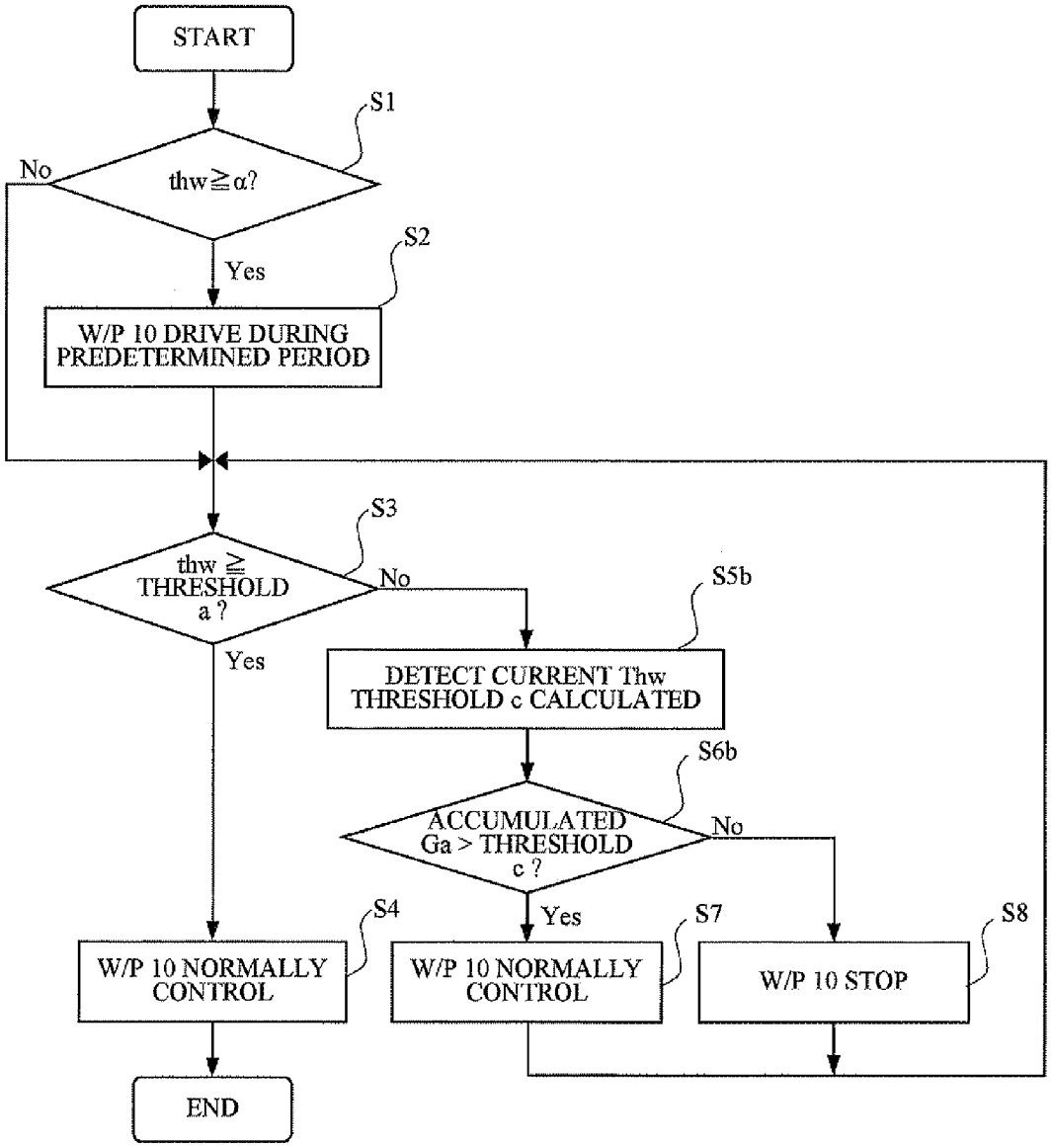
FIG. 4 is a view of a flowchart of an operation of an ECU 1B.

Next, the operation of the ECU 1B will be described with reference to the flowchart illustrated in FIG. 4. Additionally, the flowchart is substantially similar to the flowchart illustrated in FIG. 3, except that step S5*a* is changed to step S5*b* and step S6*a* is changed to step S6*b*. For this reason, step S5*b* and step S6*b* will be mainly described in the present embodiment. Just after the negative determination in step S3, the ECU 1B detects the current coolant temperature thw and calculates the threshold c with reference to the map data (step S5*b*). Subsequently, the ECU 1B calculates the accumulated intake air quantity Ga and determines whether or not the accumulated intake air quantity Ga is equal to or higher than the threshold c (step S6*b*). When this result is an affirmative determination, the process proceeds to step S7. When this result is a negative determination, the process proceeds to step S8.

In the ECU 1B performing such an operation, the coolant temperature is made uniform in starting the engine 20 in step S2 if necessary. This suitably detects the initial value of the current coolant temperature thw. For this reason, like the ECU 1A, the ECU 1B performing such an operation can prevent the coolant from partially boiling without limiting the promotion of the warm-up in starting engine 20 more than necessary. Moreover, the warm-up of the engine 20 can be suitably promoted while the partial boiling of the coolant can be prevented during the warm-up of the engine 20.

[Third Embodiment]

An ECU 1C according to the present embodiment is substantially similar to the ECU 1A, except that the drive control portion is achieved as described later. Additionally, in the ECU 1B, the drive control portion can be achieved as described below. In the present embodiment, the drive control portion is achieved to control the W/P 10 to pressure-feed a second flow rate of the coolant lower than a first flow rate of the coolant before the W/P 10 is controlled to pressure-feed the first flow rate of the coolant, in cases where the drive control portion shifts the operational state of the W/P 10 from the stop state to the drive state.

Specifically, the drive control portion is achieved to control the W/P 10 to pressure-feed the first flow rate of the coolant, when the predetermined period is elapsed after starting controlling the W/P 10 to pressure-feed the second flow rate of the coolant. Also, the drive control portion is achieved to control the W/P 10 in the above manner, in cases where the operational state of the W/P 10 is shifted to the drive state from the stop state, specifically, in cases where the operational state of the W/P 10 is shifted to the drive state from the stop state performed by the stop control portion.

Further, the drive control portion is achieved to control the W/P 10 in the above manner, in cases where the operational state of the W/P 10 is shifted to the drive state from the stop state, specifically, in cases where the portion according to the second drive control portion shifts the operational state of the W/P 10 to the drive state from the stop state. Thus, the flow rate of the coolant, in which the portion according to the second drive control portion controls the W/P 10, corresponds to the first flow rate. The portion, of the drive control portion, achieved in the above manner corresponds to the third drive control portion. Further, the flow rate of the coolant, in which the portion corresponding to the third drive control portion controls the W/P 10, corresponds to the second flow rate.

Figure 5:
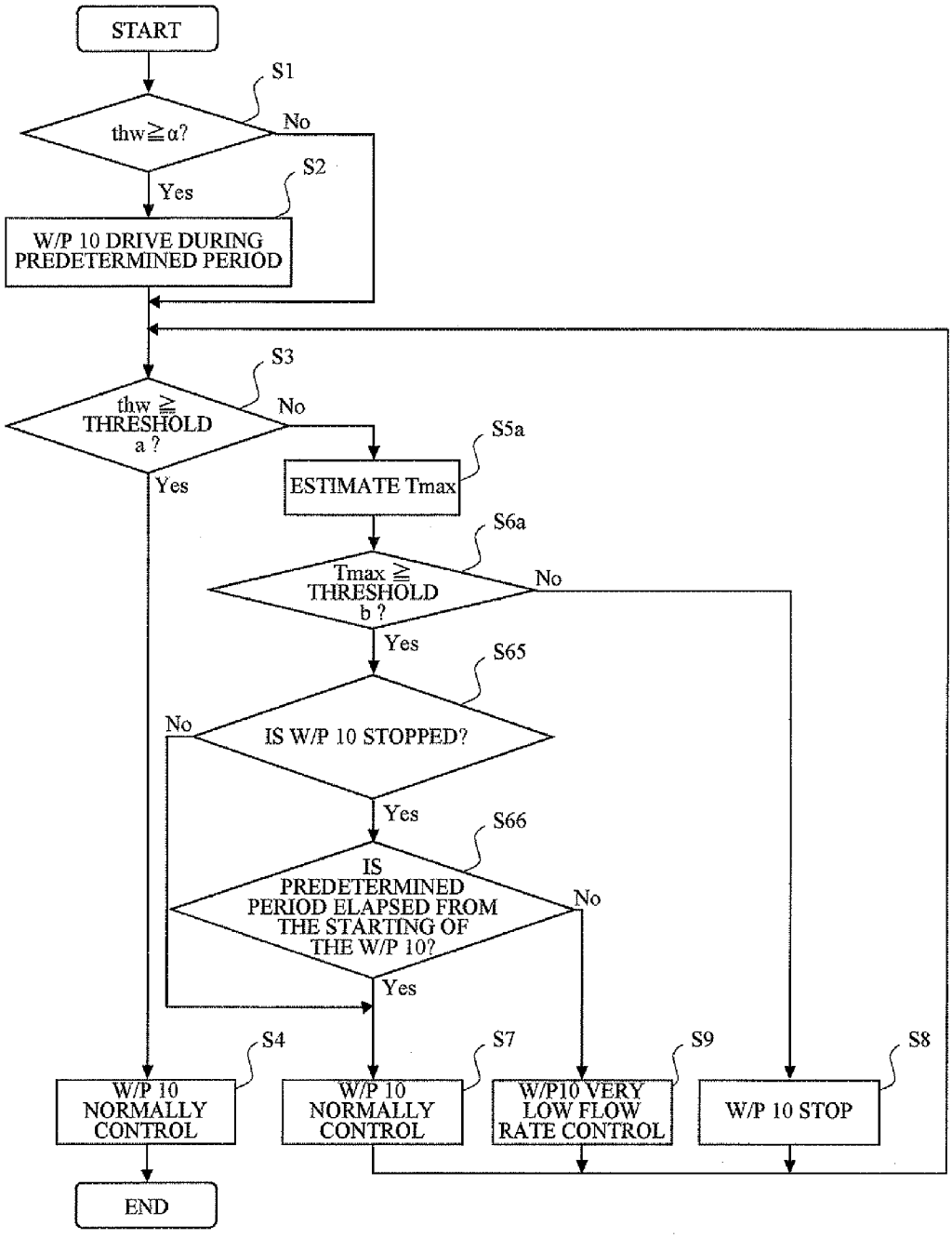
FIG. 5 is a view of a flowchart of an operation of an ECU 1C.

Next, the operation of the ECU 1C will be described with reference to a flowchart illustrated in FIG. 5. Additionally, this flowchart is substantially similar to the flowchart illustrated in FIG. 3, except that step S65 and step S 66 are added afterward the affirmative determination in step S6*a* and the step S9 is added. For this reason, step S65, S66 and S9 will be mainly described herein. When the portion corresponding to the second drive control portion shifts the operational state of the W/P 10 to the drive state from the stop state, this corresponds to the case where the determination is affirmative in step S6*a*. For this reason, in cases where the determination is affirmative in step S6*a*, the ECU 1C firstly determines whether or not the W/P 10 is stopped in step S8 after the engine 20 starts (step S65).

In cases where the determination is negative in step S3 after the engine 20 starts and the process arrives at step S65, the determination is negative in step S65 because the process has not reached at step S8 yet. This process proceeds to step S7 in this case. This adequately cools the coolant in staring the engine 20 if necessary. In contrast, the case where the determination is affirmative in step S65 corresponds to the case where the operational state of the W/P 10 is shifted to the drive state from the stop state performed by the stop control portion (however, when the W/P 10 stops). In this case, the ECU 1C determines whether or not the predetermined period is elapsed from the time when the ECU 1C starts controlling the W/P 10 to flow the coolant at the second flow rate (step S66). In this regard, when the predetermined period is not elapsed (including when the W/P 10 is the stop state), the determination is negative in step S66. At this time, the process proceeds to step S9, and then the ECU 1C controls the W/P 10 to flow the coolant at the second flow rate (an extremely low flow rate control of the W/P 10).

After that, the process proceeds to step S66 unless the determination is affirmative in step S3 and the determination is negative in step S6*a*. Further, the determination is negative in step S66 until the predetermined period is elapsed. When the predetermined period is elapsed, the determination is affirmative in step S66 and the coolant is pressure-fed at the first flow rate (step S7). Therefore, the coolant can be pressure-fed at the second flow rate for the predetermined period, in cases where the operational state of the W/P 10 is shifted to the drive state from the stop state.

Figure 6:
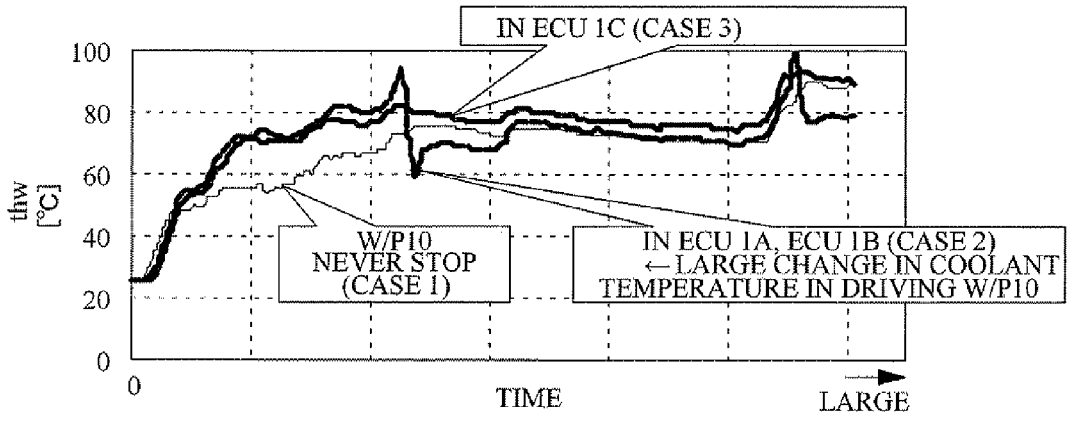
FIG. 6 is a view of a change in coolant temperature thw in cases where the ECU 1 performs the control, in cases where a W/P 10 is not stopped (case 1), and in cases where the ECU 1A and the ECU 1B perform the control (case 2), for reference.

Next, a change in the coolant temperature thw by the above control will be described with reference to FIG. 6. As for a conventional and general technique, it can be understood that an increase in the coolant temperature thw requires time in cases where the W/P 10 is not controlled to stop (in the case 1). In contrast, it can be understood that the output from the water temperature sensor 71 is undershoot when the operational state of the W/P 10 is shifted to the drive state from the stop state in cases where the ECU 1A or 1B performs the control (in the case 2). This is because the flow rate of the coolant suddenly increases. This means that the engine 20 is located in a condition where an environmental change is severe. Additionally, this means that the degradation of the control property such as loss of control might be caused by a sudden change in the output.

In contrast, the extremely low flow rate control using the second flow rate is performed as the shift process when the operational state of the W/P 10 is shifted to the drive state from the stop state, in the ECU 1C performs the control (in the case 3). For this reason, the output from the water temperature sensor 71 can be suppressed from being undershoot by the ECU 1C. The ECU 1C can protect the part and prevent or suppress the degradation of the control property when the operational state of the W/P 10 is shifted to the drive state from the stop state, as compared with the ECU 1A or 1B.

The present invention is not limited to the above-mentioned embodiment, and other embodiments, variations and modifications may be made without departing from the scope of the present invention. In the above embodiments, the description has been given to the W/P 10 as the variable water pump. However, the present invention is not limited to this. The variable water pump may be a water pump with a clutch mechanism capable of controlling the flow rate of the coolant to be set at least zero.

In the above embodiments, the W/P 10 is controlled to drive for the predetermined period at least before the stop control portion performs the control, in cases where the coolant temperature thw in staring the engine 20 is equal to or higher than the predetermined value $\alpha$. The coolant temperature thw is conceivably suitable for a parameter in cases where it is determined whether or not the coolant temperature in staring the engine 20 is almost uniform. However, the present invention is not limited to this. For example, the first drive control portion may control the variable water pump to drive for a predetermined period at least before the stop control portion performs the control, when the stop period of the engine is equal to or more than a predetermined value, instead of when the coolant temperature in staring the engine is equal to or higher than the first predetermined value. For example, the first drive control portion may control the variable water pump to drive for a predetermined period at least before the stop control portion performs the control, on the basis of the coolant temperatures in stopping the engine and sequentially in starting the engine, instead of when the coolant temperature in staring the engine is equal to or higher than the first predetermined value. That is, the first drive control portion may perform the control on the basis of the parameter which can determine whether or not the coolant temperature in starting the engine is almost uniform.

It is reasonable to achieve various portions such as the stop control portion, the drive control portion including the first, second, and third drive control portions, the estimation portion by the ECU mainly controlling the engine 20. For example, these portions may be achieved by another electric controller, a hardware such as a special electric circuit, or the combination. In this regard, the various portions such as the stop control portion, the drive control portion, and the estimation portion may be achieved by plural electric controllers, a hardware such as plural electric circuits, or the combination in a decentralized manner. Moreover, each of the first, second, and third drive control portions may be achieved as an individual control portion.

Description of Letters or Numerals

ECU 1A, 1B, 1C
W/P 10
Engine 20
Cylinder block 21
Cylinder heads 22
Electrorical control throttle 30
Heater 40
Radiator 50
Thermostat 60
Airflow meter 70
Engine cooling system 100

The invention claimed is:

1. A control device for a variable water pump, the control device comprising:

a stop control portion controlling the variable water pump to stop, when an engine provided with the variable water pump pressure-feeding a coolant is warmed up; and a drive control portion controlling the variable water pump to drive for a predetermined period at least before the stop control portion performs a control, when a coolant temperature in starting the engine is equal to or higher than a first predetermined value and lower than 75 degrees Celsius.

2. The control device for a variable water pump of claim 1, wherein the stop control portion controls the variable water pump to stop, when the coolant temperature is equal to or lower than a predetermined value smaller than the first predetermined value.

3. The control device for a variable water pump of claim 1, further comprising:

an estimation portion estimating a coolant temperature in a predetermined part of the engine, when the engine is warmed up; and a drive control portion controlling the variable water pump to drive, when the coolant temperature estimated by the estimation portion is equal to or higher than a second predetermined value.

4. The control device for a variable water pump of claim 3, wherein the stop control portion controls the variable water pump to stop, when the coolant temperature estimated by the estimation portion is equal to or lower than a predetermined value smaller than the second predetermined value.

5. The control device for a variable water pump of claim 3, wherein the estimation portion calculates a quantity of heat received by the coolant on the basis of one of a rotational number of the engine, an output of a shaft of the engine, and an quantity of intake air, calculates a coolant temperature difference between the coolant temperature in the predetermined part and a coolant temperature in a coolant outlet portion of the engine on the basis of the quantity of heat, and calculates the coolant temperature in the predetermined part by adding the coolant temperature difference to the coolant temperature in the coolant outlet.

6. The control device for a variable water pump of claim 3, wherein the estimation portion estimates the coolant temperature in the predetermined part on the basis of the coolant temperature and an accumulated intake air quantity.

7. The control device for a variable water pump of claim 1 further comprising a driving control portion controlling the variable water pump to pressure-feed a second flow rate of the coolant smaller than a first flow rate of the coolant before controlling the variable water pump to pressure-feed the first flow rate of the coolant, in a case where an operational state of the variable water pump is shifted from a stop state controlled by the stop control portion into a drive state.

8. A control device for a variable water pump, the control device comprising:

a stop control portion controlling the variable water pump to stop, when an engine provided with the variable water pump pressure-feeding a coolant is warmed up;

a first drive control portion controlling the variable water pump to drive for a predetermined period at least before the stop control portion performs a control, when a coolant temperature in starting the engine is equal to or higher than a first predetermined value;

an estimation portion estimating a coolant temperature in a predetermined part of the engine, when the engine is warmed up;

a second drive control portion controlling the variable water pump to drive, when the coolant temperature estimated by the estimation portion is equal to or higher than a second predetermined value; and a third drive control portion controlling the variable water pump to pressure-feed a second flow rate of the coolant smaller than a first flow rate of the coolant, before controlling the variable water pump to pressure-feed the first flow rate of the coolant, in a case where an operational state of the variable water pump is shifted from a stop state into a drive state by the second drive control portion, and the third drive control portion controlling the variable water pump to pressure-feed the first flow rate of the coolant, when a predetermined period is elapsed from a time when the controlling the variable water pump to pressure-feed the second flow rate of the coolant is started.

* * * * *